US010557666B2

(12) United States Patent
Yamaguchi

(10) Patent No.: US 10,557,666 B2
(45) Date of Patent: Feb. 11, 2020

(54) COOLING APPARATUS FOR METAL STRIP

(71) Applicant: CHUGAI RO CO., LTD., Osaka-shi, Osaka (JP)

(72) Inventor: Hideo Yamaguchi, Osaka (JP)

(73) Assignee: CHUGAI RO CO., LTD., Osaka-shi (JP)

( * ) Notice: Subject to any disclaimer, the term of this patent is extended or adjusted under 35 U.S.C. 154(b) by 203 days.

(21) Appl. No.: 15/807,962

(22) Filed: Nov. 9, 2017

(65) Prior Publication Data

US 2018/0363983 A1 Dec. 20, 2018

(30) Foreign Application Priority Data

Jun. 19, 2017 (JP) ..... 2017-119718

(51) Int. Cl.
*F27D 9/00* (2006.01)
*C21D 9/573* (2006.01)
*F27D 19/00* (2006.01)

(52) U.S. Cl.
CPC ..... *F27D 9/00* (2013.01); *C21D 9/5735* (2013.01); *F27D 2009/0075* (2013.01); *F27D 2009/0086* (2013.01); *F27D 2019/0003* (2013.01)

(58) Field of Classification Search
CPC ..... C21D 9/5735; F27D 2009/0075; F27D 2009/0086
USPC ..... 266/113
See application file for complete search history.

(56) References Cited

U.S. PATENT DOCUMENTS

2012/0235331 A1* 9/2012 Lemay ..... B21B 45/0218 266/44
2018/0363983 A1* 12/2018 Yamaguchi ..... F27D 9/00

FOREIGN PATENT DOCUMENTS

JP 54-153755 A * 12/1979
JP 9-010656 A 1/1997
JP 2008-073765 A 4/2008
JP 2013-240808 A 12/2013

* cited by examiner

*Primary Examiner* — Scott R Kastler
(74) *Attorney, Agent, or Firm* — Birch, Stewart, Kolasch & Birch, LLP

(57) ABSTRACT

A cooling apparatus includes: a first air nozzle configured to spray air to the metal strip from above; a first water nozzle configured to spray water to the metal strip from above; and a gas discharging part configured to discharge an air around the metal strip upwardly, wherein the first air nozzle, the first water nozzle and the gas discharging part are aligned along a transport direction of the metal strip in the order of the first air nozzle, the first water nozzle and the gas discharging part, wherein the cooling apparatus is adapted to collide the air from the first air nozzle against the metal strip and then the air moves along a surface of the metal strip to a point at which steam is generated by the water from the first water nozzle, and is adapted to discharge the steam using the gas discharging part.

7 Claims, 4 Drawing Sheets

COOLING APPARATUS FOR METAL STRIP

CROSS-REFERENCE TO RELATED APPLICATIONS

The contents of specifications, drawings and claims of the Japanese patent application No. 2017-119718 filed Jun. 19, 2017 are herein expressly incorporated by reference in their entirety.

FIELD OF THE INVENTION

This disclosure relates to a cooling apparatus configured to continuously transport a metal strip after heat treatment and cool the metal strip.

BACKGROUND OF THE INVENTION

With respect to cooling a metal strip after heat treatment, Patent Document 1 (Japanese Laid-Open Patent Publication No. H9-10656) discloses a method of cooling a metal strip by spraying air to the metal strip. Also, Patent Document 2 (Japanese Laid-Open Patent Publication No. 2013-240808) discloses a method of cooling a metal strip by spraying water to the metal strip.

SUMMARY OF THE INVENTION

However, the air cooling alone has a weak effect of cooling. On the other hand, the water cooling alone will cause boiling of water on a surface of the metal strip whose temperature is high and also forming a steam film (referred to as "film boiling") which enwraps steam therein. The steam film prevents sprayed water from contacting with the metal strip. The steam film is randomly generated, thereby leading to non-uniform cooling of the metal strip.

On the other hand, there is a cooling apparatus for cooling a metal strip using both of water and air. Patent Document 3 (Japanese Laid-Open Patent Publication No. 2008-73765) discloses such a cooling apparatus to cool a metal strip by repeatedly spraying air and water to the metal strip.

Even with the cooling apparatus of Patent Document 3, the metal strip may not uniformly be cooled, because the film boiling occurs when water is sprayed to the surface of the metal strip whose temperature is high.

This disclosure solves the above problem and an object thereof is to enable a cooling apparatus to cool a metal strip after heat treatment more uniformly and more rapidly (in a short distance).

A cooling apparatus of an aspect of this disclosure is a cooling apparatus configured to continuously transport a metal strip after heat treatment and cool the metal strip, the cooling apparatus comprising: a first air nozzle configured to spray air to the metal strip from above; a first water nozzle configured to spray water to the metal strip from above; and a gas discharging part configured to discharge an air around the metal strip upwardly, wherein the first air nozzle, the first water nozzle and the gas discharging part are aligned along a transport direction of the metal strip in the order of the first air nozzle, the first water nozzle and the gas discharging part, wherein the cooling apparatus is adapted to collide the air from the first air nozzle against the metal strip and then the air moves along a surface of the metal strip to a point at which steam is generated by the water from the first water nozzle, and is adapted to discharge the steam using the gas discharging part.

According to the configuration, formation of steam film wrapping therein steam due to film boiling can be suppressed and thus a metal strip can be cooled more uniformly.

The cooling apparatus may further include a controller configured to control a spray mount of the air from the first air nozzle and a spray amount of the water from the first water nozzle. According to the configuration, the optimal cooling rate can be realized corresponding to the material and the like of the metal strip, and the metal strip having desired properties can be produced.

In the cooling apparatus, the controller may control the spray amount of the air from the first air nozzle and the spray amount of the water from the first water nozzle based on a predetermined cooling rate of the metal strip. According to the configuration, the optimal cooling rate can be realized corresponding to the desired cooling rate for the metal strip and the metal strip having desired properties can be produced.

Also, the metal strip may be made from aluminum. Aluminum is a material whose properties tend to be varied by the cooling rate, while the cooling apparatus can realize a desired cooling rate which is unable to be acquired with only the air cooling or only the water cooling, with preventing generation of film boiling.

The cooling apparatus may further include a second water nozzle configured to spray water to the metal strip from above; and a second air nozzle configured to spray air to the metal strip from above, wherein the second water nozzle and the second air nozzle are disposed on a downstream side of the gas discharging part in the transport direction of the metal strip and aligned along the transport direction of the metal strip in the order of the second water nozzle and the second air nozzle, wherein the cooling apparatus is adapted to collide the air from the second air nozzle against the metal strip and then the air moves along the surface of the metal strip to a point at which steam is formed by the water from the second water nozzle, and is adapted to discharge the steam using the gas discharging part. According to the configuration, the cooling rate can be improved, the number of the air discharging part can be minimized, and a low cost can be achieved.

According to this disclosure, a metal strip can be cooled more uniformly.

DETAILED DESCRIPTION OF THE PREFERRED EMBODIMENTS

Preferred embodiments of a cooling apparatus and a cooling method according to this disclosure will be described with reference to the accompanying drawings. This disclosure is not limited to the exemplified configuration of each of the following embodiments, and includes various configurations based on the same technical idea as that of the embodiments.

First Embodiment

Figure 1:
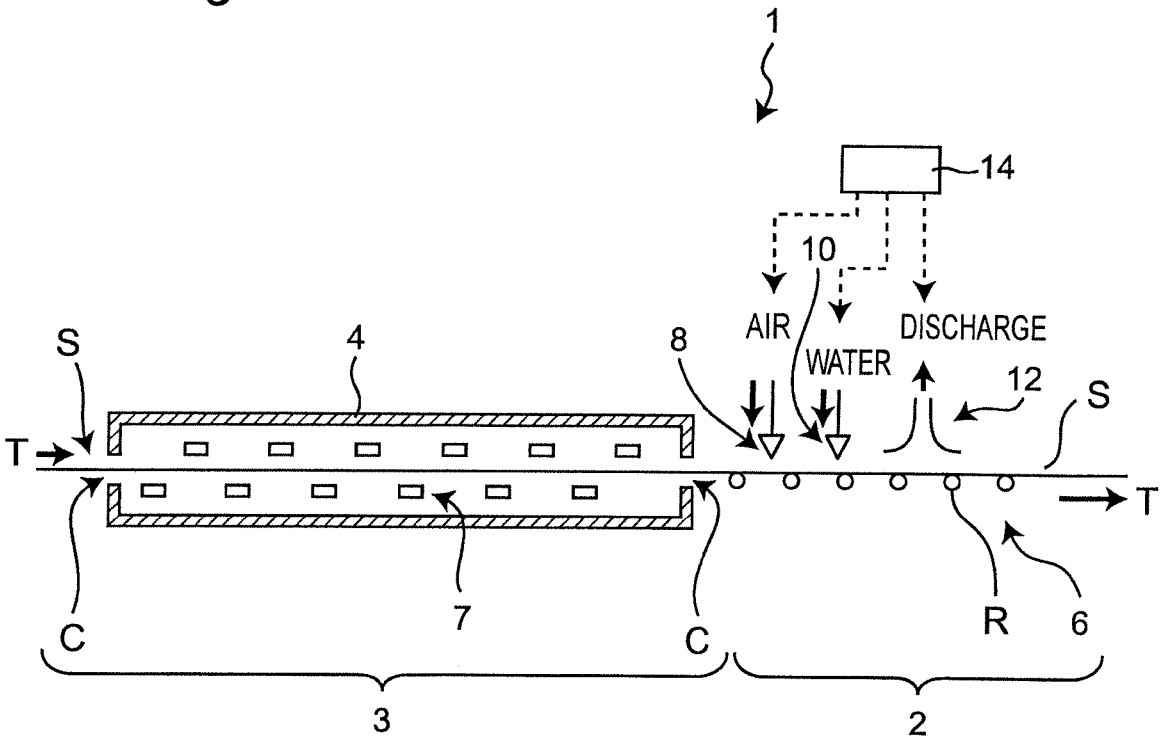
FIG. 1 is a diagram of an outlined configuration of a cooling apparatus in a first embodiment.

FIG. 1 is a diagram of an outlined configuration of a cooling apparatus 2 and a heat treatment apparatus 1 including the cooling apparatus 2 according to the first embodiment.

The heat treatment apparatus 1 is an apparatus configured to perform heat treatment to a metal strip S. As depicted in FIG. 1, the heat treatment apparatus 1 includes the cooling apparatus 2 and a heating apparatus 3.

The cooling apparatus 2 is an apparatus for the metal strip S configured to cool the metal strip S with continuously transporting the metal strip S after heat treatment by the heating apparatus 3.

The cooling apparatus 2 includes a transporting part 6, an air nozzle 8, a water nozzle 10, a gas discharging part 12, and a controller 14. For cooling the metal strip S, the cooling apparatus 2 sprays air using the air nozzle 8 to the metal strip S after the heat treatment and then sprays water to the metal strip S using the water nozzle 10 on the downstream side of the air nozzle 8, with continuously transporting the metal strip S in a transport direction T using the a transporting part 6.

In particular, a gas discharging part 12 is provided on the downstream side of the water nozzle 10 to discharge air (atmosphere) around the metal strip S upwardly. By discharging of the air, the pressure of the steam generated on the surface of the metal strip S is reduced, and thus formation of steam film (boiling film), that is a water film wrapping the steam therein, is suppressed, and uniform cooling of the metal strip S is facilitated.

Each of the components of the heat treatment apparatus 1 will be described below.

The heating apparatus 3 is an apparatus configured to heat the metal strip S. The heating apparatus 3 includes a furnace body 4 and a transporting part 7.

The furnace body 4 is a housing configured to heat the metal strip S. The metal strip S is transported into the furnace body 4. For example, if the metal strip S is made from aluminum, the metal strip S is transported out of the furnace body 4, with heated at about 580° C., and then moved into the cooling apparatus 2. Aluminum is a material whose properties tend to be varied depending on the cooling rate at which aluminum is cooled, and thus suitable for the cooling by the cooling apparatus 2 according to the first embodiment.

A slit-like opening C for transporting the metal strip S into or out of the furnace body 4 is provided in each of an entrance portion and an exit portion of the furnace body 4.

The transporting part 7 sprays hot air from above and from underneath to the metal strip S to float and continuously heat the metal strip S. The metal strip S being floated by the transporting part 7 has an end portion in the traveling direction, the end portion being wound up by a winding-up apparatus (not depicted) into a coil for transporting the metal strip S.

The transporting part 6 of the cooling apparatus 2 is a member configured to continuously transport the metal strip S along the transport direction T. FIG. 1 shows an example where the metal strip S is supported by heat-resistant rollers R from underneath. Not limited to the heat-resistant rollers R, the transporting part 6 may take any form.

The air nozzle 8 is a member configured to spray air to the metal strip S. The air nozzle 8 has a function of cooling the metal strip S by bringing air into contact with the metal strip S after heat treatment, and also has a function of preventing water film boiling from occurring as described later. The air nozzle 8 is disposed above the metal strip S and sprays air to the metal strip S from above.

The water nozzle 10 is a member configured to spray water to the metal strip S. The water nozzle 10 has a function of cooling the metal strip S by bringing water into contact with the metal strip S. A cooling effect with water from the water nozzle 10 is significantly larger than a cooling effect with air from the air nozzle 8. Similar to the air nozzle 8, the water nozzle 10 is disposed above the metal strip S and sprays water to the metal strip S from above.

The gas discharging part 12 is a member configured to discharge air (atmosphere) around the metal strip 8 to remove steam generated by the water spraying. The gas discharging part 12 according to the first embodiment performs forced exhaust using suction. Similar to the air nozzle 8 and the water nozzle 10, the gas discharging part 12 is disposed above the metal strip S and upwardly discharges the air around the metal strip S after the air cooling and the water cooling.

The controller 14 is a member configured to control operations of the cooling apparatus 2 and the heating apparatus 3. In particular, the controller 14 according to the first embodiment can control the amount of air sprayed from the air nozzle 8, the amount of water sprayed from the water nozzle 10, and the discharge amount of the air from the gas discharging part 12. The controller 14 is a micro-computer, for example.

As depicted in FIG. 1, the air nozzle 8, the water nozzle 10, and the gas discharging part 12 are disposed sequentially from the upstream side along the transport direction T of the metal strip S, in the order of the air nozzle 8, the water nozzle 10 and the gas discharging part 12. Such an arrangement can suppress generation of boiling film generated by the water spraying to the metal strip S, and thus the metal strip S is uniformly cooled. Regarding this matter, explanation will be made below with reference to FIG. 2A, FIG. 2B, FIG. 3A, FIG. 3B, and FIG. 5.

Figure 2A:
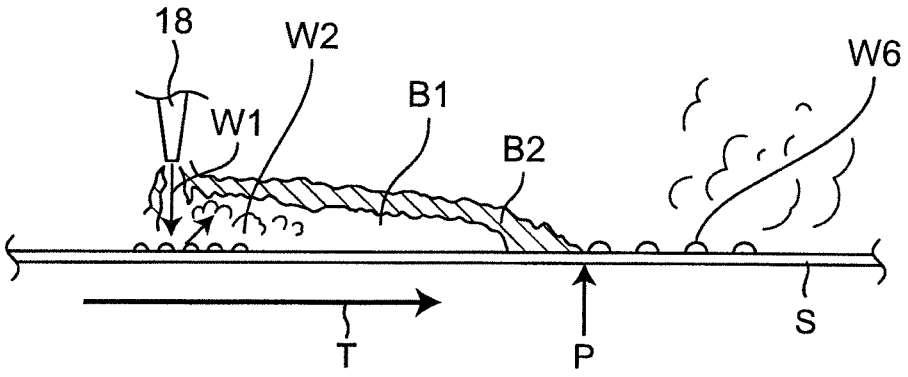
FIG. 2A is an explanatory schematic diagram of a cooling form of a metal strip in Comparative Example.
Figure 2B:
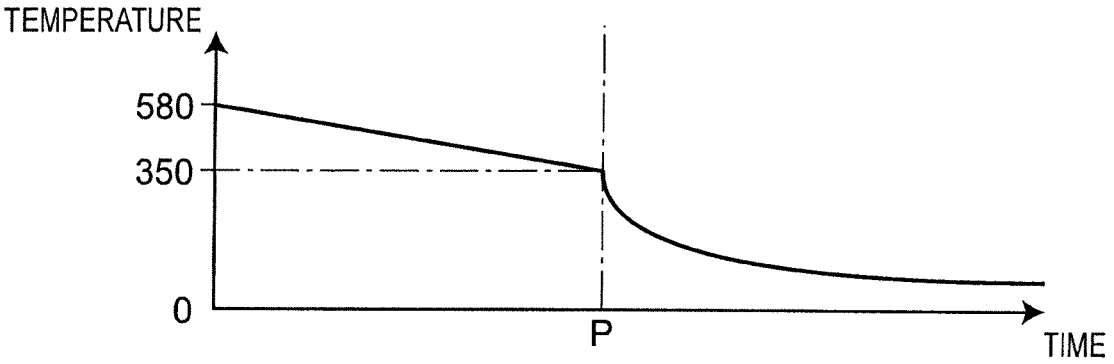
FIG. 2B is a graph of temperature variation of the metal strip in Comparative Example.
Figure 3A:
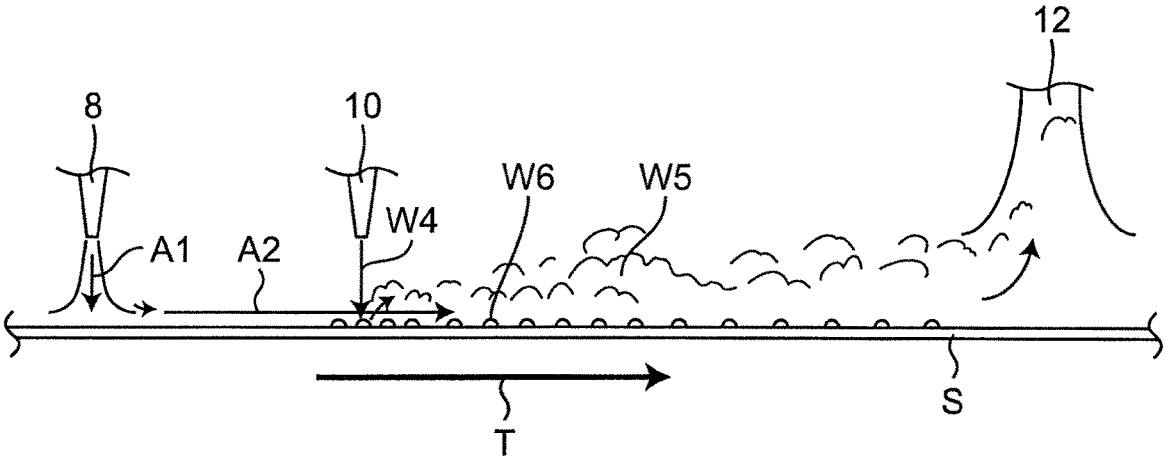
FIG. 3A is an explanatory schematic diagram of a cooling form of a metal strip in Working Example of a first embodiment.
Figure 3B:
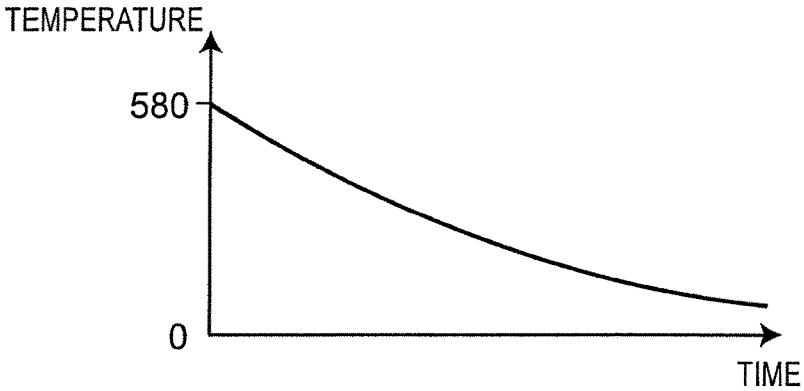
FIG. 3B is a graph of temperature variation of the metal strip in Working Example of the first embodiment.

FIGS. 2A and 2B are a diagram and a graph both corresponding to Comparative Example, respectively, showing ordinary film boiling. FIGS. 3A and 3B are a diagram and a graph both corresponding to Working Example of the first embodiment, respectively.

FIGS. 2A and 3A are explanatory schematic diagrams of cooling forms of the metal strip S according to Comparative Example and Working Example, respectively. FIGS. 2B and 3B are graphs of temperature variation according to Comparative Example and Working Example, respectively.

Figure 5:
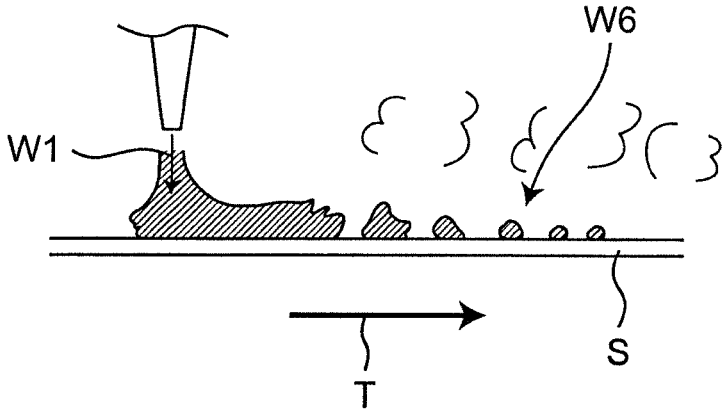
FIG. 5 is a schematic diagram for explaining a case where no film boiling occurs.

FIG. 5 is a schematic diagram of the case where no film boiling occurs and thus water cooling is normally performed. When the heating temperature of the metal strip S is low, the total amount of water W1 sprayed from the nozzle can be brought into contact with the surface of the metal strip S in the state of a liquid and becomes water drops W6 to be boiled and evaporated to disappear (this is referred to as "nucleate boiling"). If the heating temperature of the metal strip S is equal to or lower than 350° C., heat will be removed in such a manner from the metal strip S.

Comparative Example depicted in FIG. 2A is to cool the metal strip S, which is continuously transported in the transport direction T, using only water from a water nozzle 18 (that is, water cooling alone). On the other hand, as described with reference to FIG. 1, Working Example (depicted in FIG. 3A) is to cool the metal strip S, which is continuously transported in the transport direction T, using both air from the air nozzle 8 and water from the water nozzle 10 (that is, water cooling and air cooling). Working Example is to further discharge the steam generated by the spraying of water, using the gas discharging part 12.

In Comparative Example and Working Example, the metal strip S made from aluminum and heated up to about 580° C. is cooled to 300° C.

As depicted in FIG. 2A, according to Comparative Example, the water W1 is sprayed from the water nozzle 18 to the metal strip S. In the case where the temperature of the metal strip S is high to be equal to or higher than 350° C., the water is boiled and evaporated (W2) before or immediately after the water is brought into contact with the surface even when the water is sprayed at a high pressure to the metal strip S. However, an amount of the cooling water sprayed is very large, not all the cooling water is evaporated and a portion thereof remains as a liquid. Steam and water therefore coexist on the surface of the metal strip S and, in practice, a water film B2 wrapping a steam layer B1 (hereinafter referred to as "steam film") therein is formed as depicted in FIG. 2A. The water film B2 is randomly generated at various points on the surface of the metal strip S and, with keeping such a state, the metal strip S is transported at a high velocity in the direction T. Because steam has a high heat insulating property, the steam film B2 prompts insufficient cooling. Because steam is also at a high pressure, even when water is sprayed at a high pressure to the steam film B2 from above, a force pushing up the steam film B2 from underneath prevents the steam film B2 from being broken by the water pressure. Thus, the water W1 will be further prevented from being brought into contact with the surface of the metal strip S as a liquid. Although the steam film B2 itself is also evaporated, and therefore removes the heat of the metal strip S and the temperature of the surface of the metal strip S is lowered, the cooling rate is low in this unstable cooling state as shown on a left side of variation point P in FIG. 2B.

When the temperature is reduced to be in the vicinity of 350° C., the steam layer gradually disappears and water can be brought into contact with the surface of the metal strip S in the state of a liquid to form the water drops W6, thereby leading to an ordinary nucleate boiling. At this time, the cooling rate is increased as shown on a right side of the variation point P in FIG. 2B, and thus a proper water cooling effect is achieved.

Points corresponding to the variation point P where the steam film B2 disappears are randomly generated on the surface of the metal strip S, so the thermal histories during the cooling are diversified, leading to random thermal contraction of the metal strip S. Thus, the surface of the metal strip S will make recesses and protrusions. The film boiling leads to degradation of the cooling effect, so the cooling time will be long and a long cooling zone will be necessary.

As described above, when the temperature of the metal strip S is high, cooling only by the water diversifies the thermal histories on the surface of the metal strip S due to the generation of the film boiling. The metal strip S is therefore not uniformly cooled and distortions are generated in the metal strip S.

On the other hand, in Working Example depicted in FIG. 3A, the metal strip S is cooled by spraying air A1 from the air nozzle 8 to the metal strip S on the most upstream side in the transport direction T. Because the cooling effect of air is weaker than that of water, the cooling rate of the metal strip S starts as a low rate as depicted in FIG. 3B.

The air A1 sprayed to the metal strip S thereafter moves along the surface of the metal strip S. The velocity for the air A1 to be sprayed is about 70 m/s and, even when the air A1 collides against the metal strip S, the air A1 horizontally flows substantially maintaining this velocity on the surface at 70 m/s. Air A2 moving on the surface of the metal strip S immediately moves to the point at which water W4 is sprayed to the metal strip S by the water nozzle 10.

Steam W5 is generated at the point where the water W4 is sprayed to the metal strip S from the water nozzle 10. Although the boiling film is made in Comparative Example, the air A2 moves at a high velocity to laterally cross the steam W5 in Working Example, and then the steam W5 is dispersed. Thus, the steam W5 tends to avoid being condensed and forming steam film, thereby suppressing formation of boiling film. As a result, the nucleate boiling can be performed without generating film boiling, and thus uniform cooling of the metal strip S can be facilitated.

The air A2 enters into the steam W5, and then the steam W5 is diluted. In this state, the steam W5 is at a high temperature and at a significantly high pressure to have a high boiling point, and water therefore tends to avoid being evaporated on the surface of the metal strip S, but the dilution of the steam W5 by the air A2 reduces the pressure of the steam W5. The reduction of the pressure of the steam W5 lowers the boiling point of the steam W5, thereby leading to promotion of water evaporation in the vicinity of the steam W5. Accordingly, the water can uniformly be evaporated on the surface of the metal strip S and thus uniform cooling of the metal strip S can be facilitated.

In addition, in Working Example, the gas discharging part 12 is used to perform gas discharging because a large amount of steam is generated on the surface of the metal strip S. The gas discharging by the gas discharging part 12 further reduces the pressure on the surface of the metal strip S, thereby suppressing formation of steam film due to condensation of the steam. While water becomes steam by evaporation with its volume increasing about 1,800-fold, the discharging of the steam by the gas discharging part 12 can suppress increase of the steam pressure due to the volume increase associated with the evaporation. As a result, the evaporation of the water can further be facilitated and the metal strip S can further be uniformly cooled.

According to the cooling apparatus of Working Example and the method therefor, the metal strip S having a high temperature is cooled with air and water, with avoiding generation of film boiling. As a result, the metal strip S can uniformly be cooled and thus distortion in the metal strip S can be minimized.

Different from Comparative Example, Working Example can suppress generation of film boiling and continue nucleate boiling, so a temperature gradient having a mild slope can be realized without any sudden variation in the course of the cooling as depicted in FIG. 3B. As described with reference to FIG. 1, the cooling apparatus 2 of the first embodiment uses the controller 14 to control both the spray amount of air from the air nozzle 8 and the spray amount of water from the water nozzle 10. In Working Example, the desired cooling rate of the metal strip S for aluminum is set in advance and then each of the spray amounts is controlled in accordance with the pre-set cooling rate. As a result, the desired cooling rate as depicted in FIG. 3B can be realized.

According to the cooling apparatus/method of Working Example, "water cooling after air cooling" that is an effective method of rapidly cooling the metal strip S can be performed without generating film boiling, and thus becomes a practical method.

In the cooling apparatus/method, the air nozzle 8 and the water nozzle 10 are disposed to be perpendicular to the metal strip S. Because the air nozzle 8 and the water nozzle 10 do not need to be inclined, their installation space can also be reduced. Also, rapid cooling is achieved, so the cooling zone of the apparatus can be shortened.

As described above, the cooling apparatus 2 according to the first embodiment is an apparatus configured to continuously transport the metal strip S after heat treatment and cool the metal strip S. The cooling apparatus 2 includes the first air nozzle 8, the first water nozzle 10, and the gas discharging part 12 sequentially disposed from the upstream side along the transport direction T of the metal strip S (that is, they are aligned along the transport direction T of the metal strip S in the order of the first air nozzle 8, the first water nozzle 10 and the gas discharging part 12). The first air nozzle 8 is configured to spray air to the metal strip S from above. The first water nozzle 10 is configured to spray water to the metal strip S from above. The gas discharging part 12 is configured to discharge the air (atmosphere) around the metal strip S upwardly. The cooling apparatus 2 having such a configuration is adapted to collide the air from the first air nozzle 8 against the metal strip S and then the air moves along the surface of the metal strip S to the point at which steam is generated by the water from the first water nozzle 10, and is adapted to discharge the steam using the gas discharging part 12.

According to this configuration, the cooling apparatus 2 can cool the metal strip S more uniformly and more rapidly (in a short distance).

The cooling apparatus 2 according to the first embodiment further includes the controller 14 configured to control the spray amount of the air from the first air nozzle 8 and the spray amount of the water from the first water nozzle 10. According to this configuration, adjusting the spray amount of the air and the spray amount of the water can adjust the cooling rate of the metal strip S. As a result, the optimal cooling rate for the material and the like of the metal strip S can be realized, and thus the metal strip S having desired properties can be produced.

According to the cooling apparatus 2 of the first embodiment, the controller 14 controls the spray mount of the air from the first air nozzle 8 and the spray amount of the water from the first water nozzle 10 based on a predetermined cooling rate of the metal strip S. According to this configuration, controlling the spray amounts of the water and the air based on the desired cooling rate of the metal strip S set in advance can realize the optimal cooling rate, and thus the metal strip S having desired properties can be produced.

In the first embodiment, the metal strip S is made from aluminum. While aluminum is a member whose heat conductivity is high and whose properties tend to be varied by its cooling rate, the cooling apparatus 2 according to the first embodiment can achieve a desired cooling rate which is unable to be achieved with only the air cooling or only the water cooling, with suppressing generation of film boiling. Especially, the controller 14 capable of controlling the cooling rate of the metal strip S is provided, so the cooling rate which is optimal for aluminum can be set by the controller 14, and thus the metal strip S made from aluminum and having desired properties can be produced.

Second Embodiment

A cooling apparatus 30 of a second embodiment according to this disclosure will be described. In the second embodiment, points of the cooling apparatus 30 different from the cooling apparatus 1 according to the first embodiment will be mainly described. In the second embodiment, components that are the same as or equivalent to those of the first embodiment will be described giving thereto the same reference numerals as those of the first embodiment. In the second embodiment, explanations that are made in the first embodiment will be omitted.

The one air nozzle 8 and the one water nozzle 10 are provided in the first embodiment, while the second embodiment differs from the first embodiment in that a second air nozzle 20 and a second water nozzle 22 are further provided.

Figure 4:
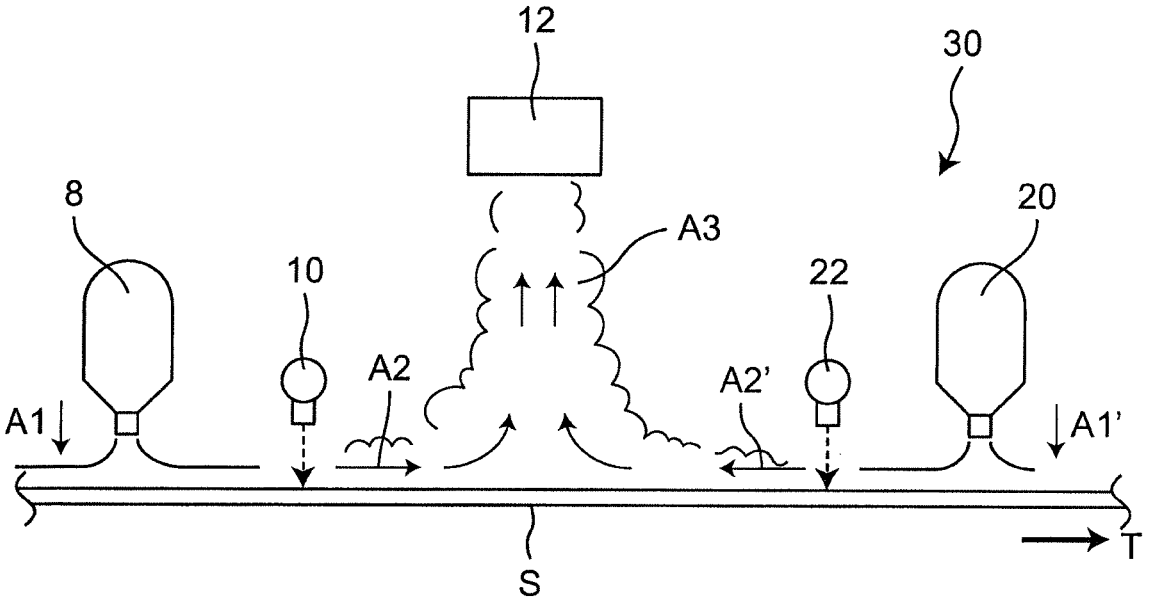
FIG. 4 is a diagram of an outlined configuration of a cooling apparatus in a second embodiment.

As depicted in FIG. 4, the cooling apparatus 30 further includes the second water nozzle 22 and the second air nozzle 20 sequentially disposed in the downstream side of the gas discharging part 12 in the transport direction of the metal strip S. The second water nozzle 22 and the second air nozzle 20 are aligned along the transport direction T of the metal strip S in the order of the second water nozzle 22 and the second air nozzle 20.

Similar to the first air nozzle 8, the second air nozzle 20 is a member configured to cool the metal strip S by spraying air from above to the metal strip S. Similar to the first water nozzle 10, the second water nozzle 22 is a member configured to cool the metal strip S by spraying water from above to the metal strip S.

With this configuration, the cooling apparatus 30 is adapted to hit the air from the second air nozzle 20 against the metal strip S and then the air moves along the surface of the metal strip S to the point at which steam is generated by the water from the second water nozzle 22.

According to this configuration, the air nozzles 8, 20 on both sides centering the gas discharging part 12 in the transport direction T causes collision of the steam from one side and from the other side at the central portion in the transport direction T, thereby taking off the steam from the surface of the metal strip S. The steam taken off therefrom is discharged in the direction perpendicular to the metal strip S, passes through a space between the first water nozzle 10 and the second water nozzle 22, and then is discharged forcibly upwardly from the gas discharging part 12 as depicted in FIG. 3A.

As described above, the cooling apparatus 30 of the second embodiment further includes the second water nozzle 22 and the second air nozzle 20 on the downstream side of the gas discharging part 12 in the transport direction T, the second water nozzle 22 and the second air nozzle 20 being aligned along the transport direction T in the order of the second water nozzle 22 and the second air nozzle 20. The cooling apparatus 30 is adapted to collide the air from the second air nozzle 20 against the metal strip S and then the air moves along the surface of the metal strip S to the point at which steam is generated by the water from the second water nozzle 22.

According to this configuration, the water nozzles 10, 22 and the air nozzles 8, 20 are disposed on both sides centering the gas discharging part 12, so the metal strip S can be cooled from the both sides. As a result, a cooling rate which is unable to be acquired with only the air cooling or only the water cooling can be realized, and thus the cooling rate can be improved. Because the only one gas discharging part 12 is provided for both the water nozzle 10 and the air nozzle 8 on the upstream side, and the water nozzle 22 and the air nozzle 20 on the downstream side, thereby realizing a relatively small number of the gas discharging part 12 with respect to the number of the water nozzles 10, 22 and the air nozzles 8, 20, and thus a low cost can be realized.

The second air nozzle 20 is provided on the downstream side in the transport direction T, but the velocity of air A2' from the second air nozzle 20 is sufficiently higher than the transport velocity of the metal strip S. Thus, the air A2' can flow toward the upstream side of the transport direction T and the same effect as that of the air A2 of the first air nozzle 8 can be achieved.

The discharge amount from the gas discharging part 12 can be adjusted based on the interval between the first water nozzle 10 and the second water nozzle 22. For example, the discharge amount will be larger as the interval is longer, while the discharge amount will be smaller as the interval is shorter. Thus, the interval may be set based on an advantageous discharge amount. For example, setting the interval between the first water nozzle 10 and the second water nozzle 22 such that the flow velocity of the gas to be discharged flowing between the first water nozzle 10 and the second water nozzle 22 is equal to or lower than 10 m/s can suppress increase of the furnace pressure in the furnace body 4.

The invention of this disclosure has been described with reference to the first and the second embodiments, but is not limited to the first and the second embodiments. For example, in each of the first and the second embodiments, the metal strip S is made from aluminum while, not limiting thereto, may be made from any metal. Aluminum is a material whose properties tend to be varied depending on the cooling rate as described above, and thus suitable for the method according the first and the second embodiments in which the adjustment of the cooling rate is easy.

In each of the first and the second embodiments, the spray amount of the air from the air nozzle 8 and the spray amount of the water from the water nozzle 10 are controllable by the controller 14 while, not limiting to thereto, the controller 14 may not be provided and the spray amounts may be manually adjusted. However, providing the controller 14 leads to a more suitable cooling rate for the material and the like of the metal strip S.

It is to be noted that, by properly combining the arbitrary embodiments of the aforementioned various embodiments, the effects possessed by them can be produced.

This disclosure is sufficiently described in relation to the preferred embodiments with reference to the accompanying drawings while various modifications and corrections thereto are obvious to those skilled in the art. It should be understood that, as far as the modifications and the corrections do not depart from the scope of this disclosure on the basis of the appended claims, the modifications and the corrections are included in the scope. Any change of combinations and order of the elements in each of the embodiments may be realized without departing from the scope and the technical idea of this disclosure.

What is claimed is:

1. A cooling apparatus configured to continuously transport a metal strip after heat treatment and cool the metal strip, the cooling apparatus comprising:

a first air nozzle configured to spray air to an upper surface of the metal strip from above;

a first water nozzle configured to spray water to the upper surface of the metal strip from above; and a gas discharger configured to discharge air and steam from the upper surface of the metal strip upwardly, wherein the first air nozzle, the first water nozzle and the gas discharger are aligned along a transport direction on the upper surface of the metal strip in the order of first the first air nozzle, second the first water nozzle and third the gas discharger, and wherein the cooling apparatus is adapted to collide the air from the first air nozzle against the upper surface of the metal strip and then the air moves along the upper surface of the metal strip to a point at which steam is generated by the water from the first water nozzle, and is adapted to discharge the steam from the upper surface of the metal strip by using the gas discharger for suppressing a formation of steam film and for uniformly cooling the metal strip.

2. The cooling apparatus according to claim 1, further comprising a controller configured to control a spray amount of the air from the first air nozzle and a spray amount of the water from the first water nozzle.

3. The cooling apparatus according to claim 2, wherein the controller controls the spray amount of the air from the first air nozzle and the spray amount of the water from the first water nozzle on the upper surface of the metal strip to a level that provides a predetermined cooling rate of the metal strip by suppressing the formation of the steam film on the upper surface of the metal strip.

4. The cooling apparatus according to claim 1, further comprising:

a second water nozzle configured to spray water to the upper surface of the metal strip from above; and a second air nozzle configured to spray air to the upper surface of the metal strip from above, wherein the second water nozzle and the second air nozzle are disposed on a downstream side of the gas discharger in the transport direction of the metal strip and aligned along the transport direction of the metal strip in the order of the first the second water nozzle and second the second air nozzle, wherein the cooling apparatus is adapted to collide the air from the second air nozzle against the upper surface of the metal strip and then the air moves along the upper surface of the metal strip to a point at which steam is formed by the water from the second water nozzle on the upper surface of the metal strip, and is adapted to discharge the steam using the gas discharger.

5. A cooling apparatus configured to continuously transport a metal strip after heat treatment and cool the metal strip, the cooling apparatus comprising:

a first air nozzle configured to spray air to the metal strip from above; and a first water nozzle configured to spray water to the metal strip from above;

a gas discharger configured to discharge air around the metal strip upwardly;

wherein the first air nozzle, the first water nozzle and the gas discharger are aligned along a transport direction of the metal strip in the order of the first air nozzle, the first water nozzle and the gas discharger;

wherein the cooling apparatus is adapted to collide the air from the first air nozzle against the metal strip and then the air moves along a surface of the metal strip to a point at which steam is generated by the water from the first water nozzle, and is adapted to discharge the steam using the gas discharger;

a second water nozzle configured to spray water to the metal strip from above; and a second air nozzle configured to spray air to the metal strip from above;

wherein the second water nozzle and the second air nozzle are disposed on a downstream side of the gas discharger in the transport direction of the metal strip and aligned along the transport direction of the metal strip in the order of the second water nozzle and the second air nozzle, wherein the cooling apparatus is adapted to collide the air from the second air nozzle against the metal strip and then the air moves along the surface of the metal strip to a point at which steam is formed by the water from the second water nozzle, and is adapted to discharge the steam using the gas discharger.

6. The cooling apparatus according to claim 5, wherein a controller controls the spray amount of the air from the first air nozzle and the spray amount of the water from the first water nozzle on the upper surface of the metal strip to a level that provides a predetermined cooling rate of the metal strip by suppressing the formation of the steam film on the upper surface of the metal strip.

7. The cooling apparatus according to claim 5, wherein a controller controls the spray amount of the air from the second air nozzle and the spray amount of the water from the second water nozzle on the upper surface of the metal strip to a level that provides a predetermined cooling rate of the metal strip by suppressing the formation of the steam film on the upper surface of the metal strip.

* * * * *